US006242852B1

(12) United States Patent
Nakamura et al.

(10) Patent No.: US 6,242,852 B1
(45) Date of Patent: Jun. 5, 2001

(54) ELECTRON GUN

(75) Inventors: Hirofumi Nakamura, Kanagawa; Koichiro Sumi, Tokyo; Shigenori Tagami, Kanagawa, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/303,639

(22) Filed: May 3, 1999

(30) Foreign Application Priority Data

May 8, 1998 (JP) ..... 10-126455

(51) Int. Cl.[7] ..... H01J 9/00
(52) U.S. Cl. ..... 313/270; 313/337; 313/346 DC
(58) Field of Search ..... 313/270, 337, 313/346 DC, 346 R

(56) References Cited

U.S. PATENT DOCUMENTS 5,780,959 * 6/1998 Pruvost et al. ..... 313/270
6,016,026 * 1/2000 Lee ..... 313/346 DC X

FOREIGN PATENT DOCUMENTS 0436360 7/1991 (EP) .
0778604 6/1997 (EP) .

* cited by examiner

*Primary Examiner*—Ashok Patel
(74) *Attorney, Agent, or Firm*—Jay H. Maioli

(57) ABSTRACT

A heater is built in an inner sleeve of an electron gun, and an impregnated type cathode is fixed at an end portion, on the grid electrodes side, of the inner sleeve. The inner sleeve, having an outside diameter ranging from about 1.0 mm to 1.4 mm and a length substantially equal to a primary spiral length of the heater is inserted in an outer sleeve. The outer sleeve has on the grid electrodes side a small-diameter portion having an outside diameter ranging from about 2.2 mm to about 2.6 mm and on the base end side a large-diameter portion having an outside diameter ranging from about 2.6 mm to 3.0 mm. The inner sleeve is inserted in the small-diameter portion and is fixed thereto by means of strap-like tabs. A holder is fixed around the outer peripheral portion of the large-diameter portion, and is assembled in a ceramic disk via the holder.

5 Claims, 6 Drawing Sheets

ELECTRON GUN

BACKGROUND OF THE INVENTION

The present invention relates to an electron gun used for a CRT (cathode ray tube) or the like, and particularly to an electron gun in which an impregnated type cathode is provided in a heater built-in inner sleeve and the inner sleeve is connected to and supported by an outer sleeve by means of strap-like connecting members, called, tabs. In more particular, the present invention relates to an electron gun capable of leesening the diameter of the inner sleeve for reducing radiation heat propagating to grids and the like, thereby reducing power consumption in combination with prevention of inconveniences such as plane stray.

As shown in FIGS. 1 and 2, a CRT includes a tube main body T having a face panel portion F and a neck portion N, wherein an aperture grill AG and a fluorescent layer L are provided on the face panel portion F, and an electron gun E is provided on the neck portion N. The electron gun E, if it is of a Trinitron type, has prefocus lens system having three cathodes KB, KG and KR and, a first grid electrode G1 and a second grid electrode G2; a main lens system having a third grid electrode G3, a fourth grid electrode system G4AB, G4C, G4DE, and a fifth grid electrode G5; and a deflection system having a convergence deflection plate CP and a shield CS. In FIG. 2, reference character DY designates a deflection yoke.

In recent years, to improve the controllability of electron beams, the electron gun E is configured such that the cathode (hereinafter, represented by reference character K) and the first and second grid electrodes G1 and G2 are integrally assembled into a cathode structure A.

The cathode structure A is, as shown in FIGS. 3 and 4, configured such that the cathode K is fixed at an end portion, on the grid electrodes G1 and G2 side, of a heater 11 built-in inner sleeve 10; the inner sleeve 10 is inserted in an outer sleeve 20 and is fixed thereto by means of strap-like tabs (not shown); the outer sleeve 20 is mounted on a ceramic disk 22 via a holder 21; and the first grid G1 is directly provided on the ceramic disk 22 and the second grid electrode G2 is provided on the ceramic disk 22 via a spacer 23. In FIG. 3, reference numeral 30 designates a lead for making the grid electrode G1 conductive, and in FIG. 4, reference numeral 17 designates a cap for mounting the cathode.

In recent years, an impregnated type cathode K in which a porous base such as a tungsten sintered body is filled with a cathode material has been developed and has come to be used for the electron gun E shown in FIGS. 3 and 4 in place of a conventional oxide cathode.

As is known, the impregnated type cathode has an advantage that the electron emission density is higher than that for the oxide cathode, and therefore, the electron gun E using the impregnated type cathode K is advantageous in enhancing the performance of the CRT.

However, in the electron gun E using the above impregnated type cathode K it is essential to heat the impregnated type cathode K at a high temperature because the operational temperature of the impregnated type cathode K is higher than that of the oxide cathode. That is to say, the operational temperature of the oxide cathode is about 800° C., while the operational temperature of the impregnated type cathode K is about 1000° C.

As a result, there occur a first problem that a calorie transferred from the built-in heater 11 to the first and second electrodes G1 and G2 by way of the inner sleeve 10, outer sleeve 20 and ceramic disk 22 is large, thereby to increase the power consumption of the heater 11; a second problem that when the grid electrodes G1 and G2 are over-heated at high temperatures, Ba and BaO are evaporated and scattered from the cathode K and are deposited on the grid electrodes G1 and G2 to form emission sources ES (see FIG. 4), and thermal electrons are emitted from these emission sources ES, to increase the stray emission intensity, thereby exerting adverse effect not only on an image quality but also on the focus characteristic, resulting in a phenomenon (so-called plane stray) in which the center of the screen becomes bright after completion of the deflecting operation; and a third problem that a leakage current from the grid electrodes G1 and G2 is increased, to cause a malfunction of the circuit.

It is known that the above problems can be somewhat solved by reducing the area of the inner sleeve 10, that is, reducing the diameter of the inner sleeve 10, thereby reducing the radiation heat from the inner sleeve 10.

If the diameter of the inner sleeve 10 is reduced, however, a gap between the inner sleeve 10 and outer sleeve 20 becomes large, so that a calorie propagating by thermal transmission is increased, to make large the power consumption of the heater required to keep the temperature of the inner sleeve at about 1000° C., and it is required to ensure the supporting rigidity of the inner sleeve 10 fixed to the outer sleeve 20 by enlarging the dimension such as the thickness of each tab in accordance with the gap between the inner sleeve 10 and outer sleeve 20, to increase a calorie propagating by thermal conduction.

To reduce radiation heat, it may be considered to reduce not only the diameter of the inner sleeve 10 but also the diameter of the outer sleeve 20; however, if the diameter of the outer sleeve 20 is reduced, a work of connecting the outer sleeve 20 with the holder 21 upon assembly of the outer sleeve 20 in the ceramic disk 22 is complicated, and increases to increase the number of assembling steps, thereby increasing the manufacturing cost.

SUMMARY OF THE INVENTION

In view of the foregoing, the present invention has been made, and an object of the present invention is to provide an electron gun capable of reducing the caloric amount propagating to grid electrodes due to thermal conduction and thermal radiation, reducing the power consumption of a heater, preventing inconveniences such as plane stray, and simplifying the assembly of the electron gun.

To achieve the above object, according to the present invention, there is provided an electron gun including: a heater built-in inner sleeve at the leading end of which an impregnated type cathode is provided; an outer sleeve in which the inner sleeve is inserted; and strap-like connecting members for connecting the inner sleeve to the outer sleeve at a plurality of positions spaced at intervals in the peripheral direction such that the inner sleeve is disposed coaxially with the outer sleeve, the impregnated type cathode is positioned at the leading end of the outer sleeve, and the inner sleeve is separated from the outer sleeve with an annular space kept therebetween; wherein the outer sleeve has on the leading end side a small-diameter portion having a diameter smaller than that of the remaining portion of the outer sleeve on the base end side; the inner sleeve is positioned in the small-diameter portion; and the leading end of the small-diameter portion is connected to the base end of the inner sleeve by means of the strap-like connecting members.

Further, in the electron gun of the present invention, since the diameter of the inner sleeve is reduced (specificallly to a value ranging from about 1.0 mm to about 1.2 mm) and the small-diameter portion having a small diameter (specifically in a range of about 2.2 mm to about 2.6 mm) on the leading end side of the outer sleeve, a suitable gap can be formed between the inner sleeve and the small-diameter portion of the outer sleeve without reducing the diameter of the portion on the base end side of the outer sleeve (specifically while ensuring the outside diameter of the portion in a range of about 2.6 mm to about 3.0 mm).

Accordingly, it is possible to reduce a caloric amount propagating by thermal radiation and thermal transmission toward the grid electrodes, to avoid the enlargement of the tab thereby reducing the caloric amount propagating by thermal conduction, and to facilitate the assembly of the outer sleeve in the ceramic disk using the large-diameter portion of the outer sleeve.

BRIEF DESCRIPTION OF THE DRAWINGS

FIGS. 5A and 5B are schematic views of a cathode structure of an electron gun according to one embodiment of the present invention, wherein FIG. 5A is a sectional front view, and FIG. 5B is a plan view;

FIGS. 6A and 6B are views showing an essential portion of the cathode structure, wherein FIG. 6A is a sectional front view, and FIG. 6B is a plan view.

DETAILED DESCRIPTION OF THE PREFERRED EMBODIMENT

Hereinafter, one embodiment of the present invention will be described with reference to the accompanying drawings.

Figure 1:
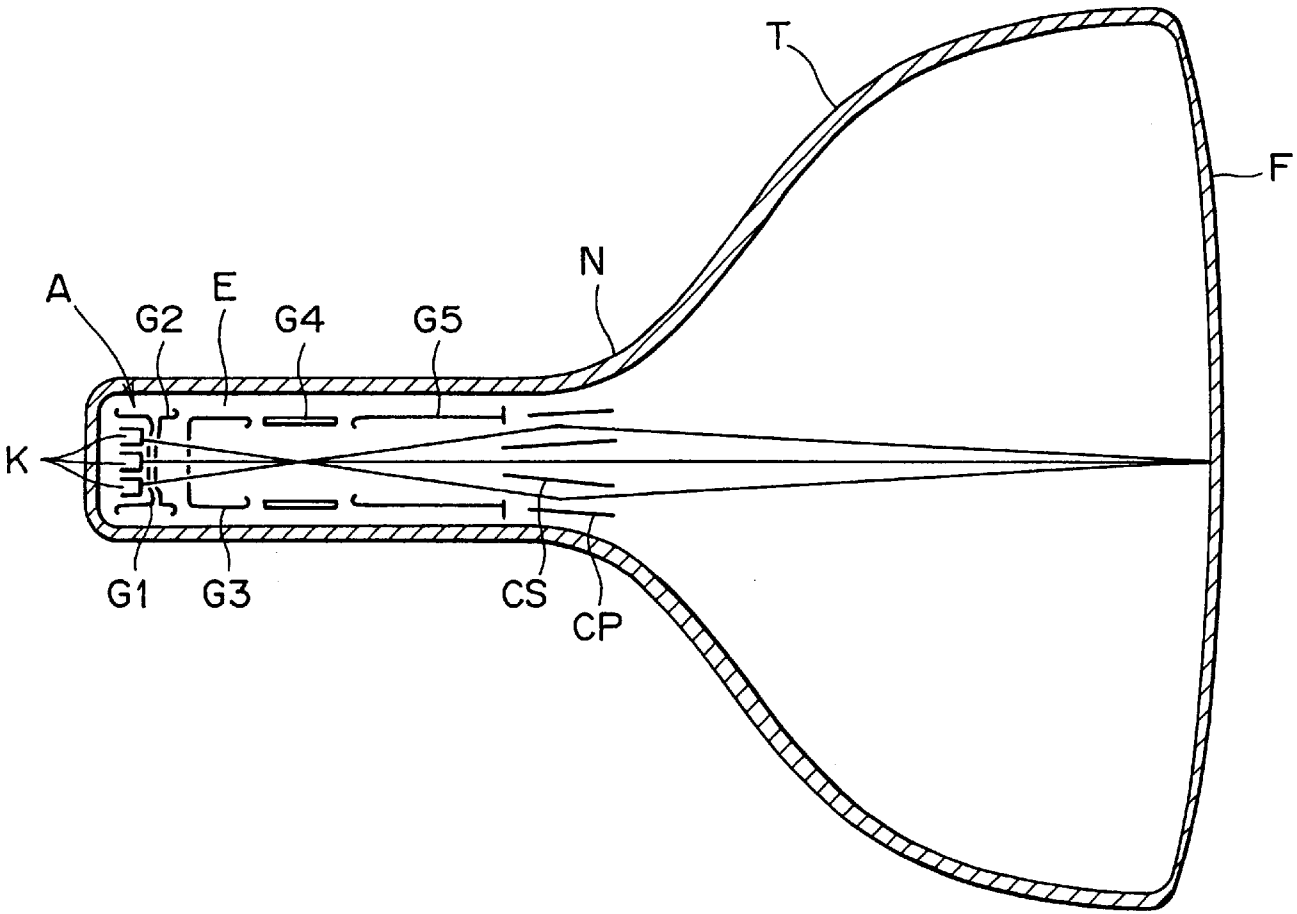
FIG. 1 is a schematic sectional view of a CRT to which an electron gun is applied.
Figure 2:
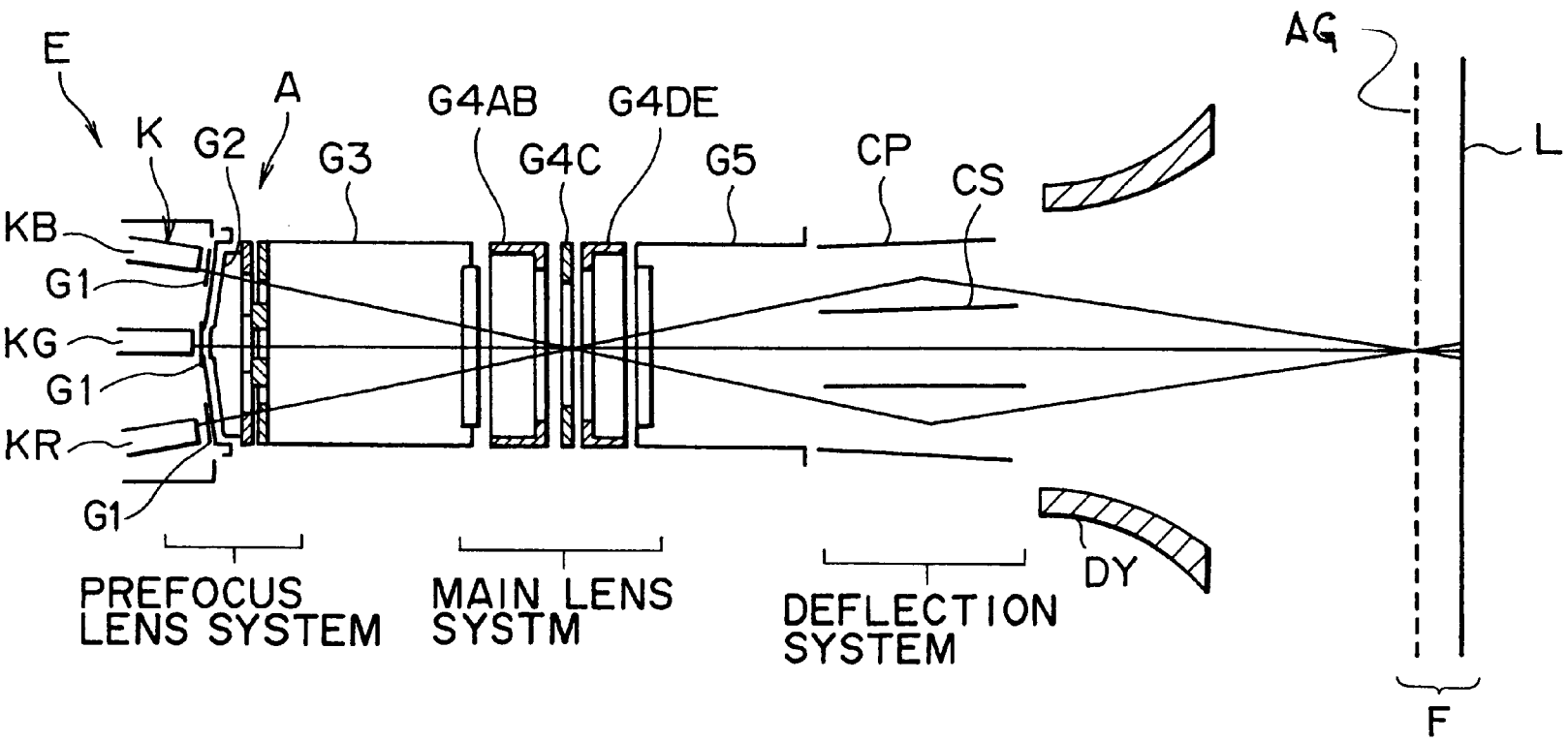
FIG. 2 is a conceptional view of the CRT to which the electron gun is applied.
Figure 3:
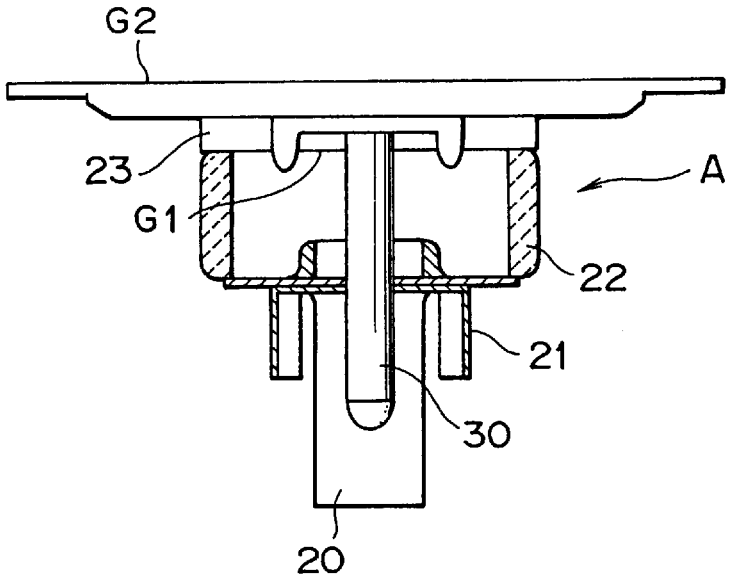
FIG. 3 is a schematic view of a related art cathode structure.
Figure 4:
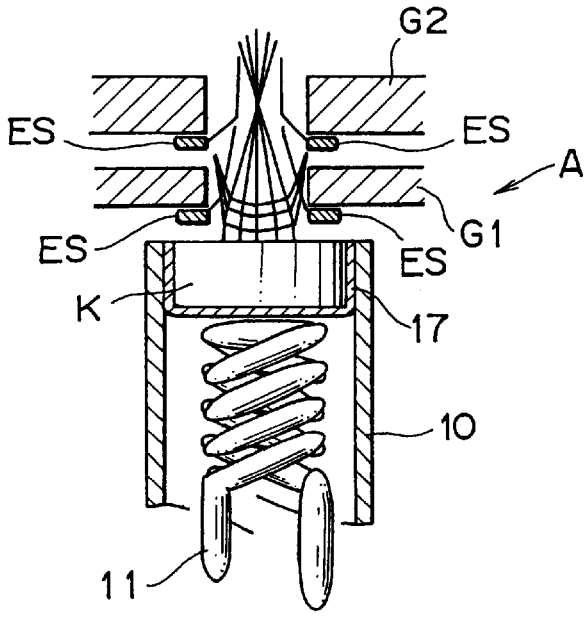
FIG. 4 is a schematic sectional view showing, on an enlarged scale, a portion of the related art cathode structure.
Figure 5A:
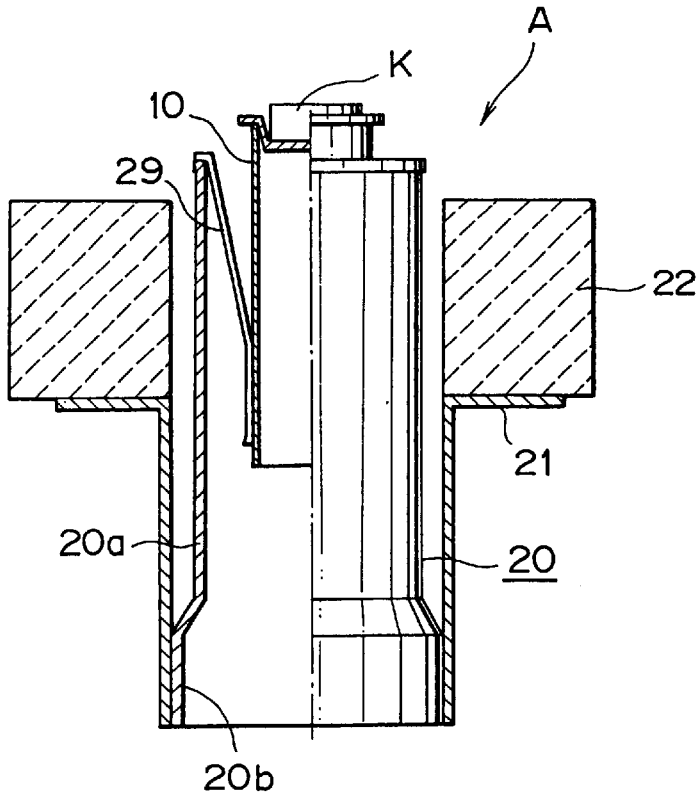
Figure 5B:
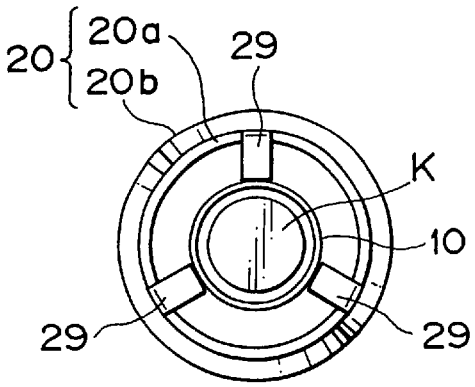
Figure 6A:
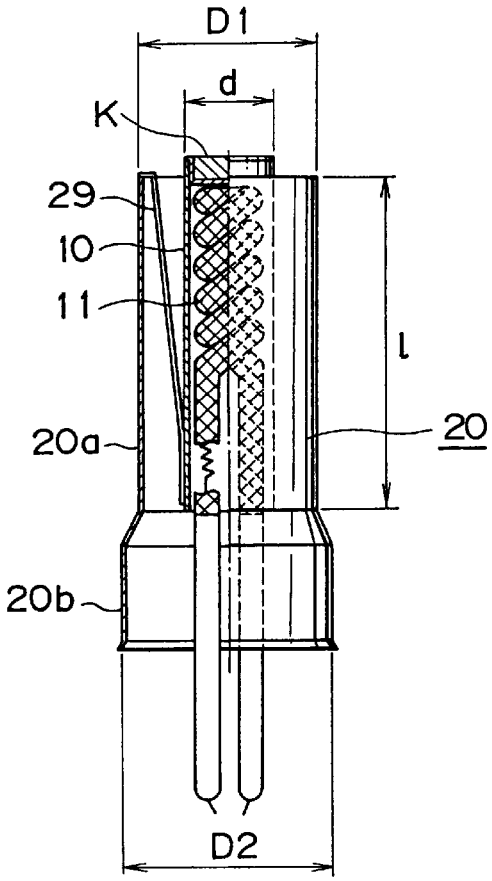
Figure 6B:
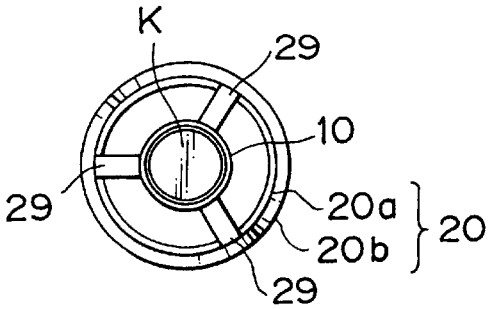
Figure 7:
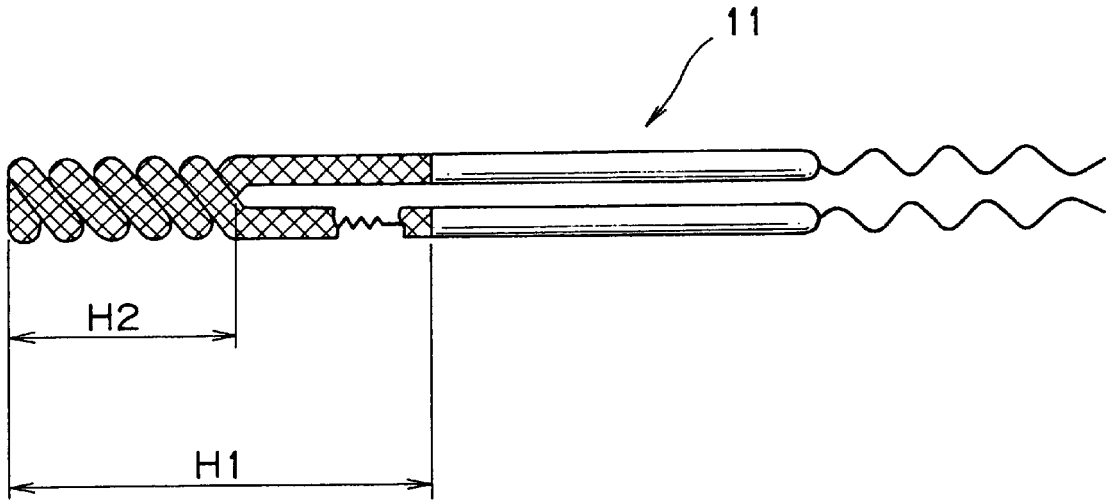
FIG. 7 is a front view of a heater used for the cathode structure.

FIGS. 5A and 5B, FIGS. 6A and 6B, and FIG. 7 show an electron gun according to one embodiment of the present invention, wherein FIGS. 5A and 5B are schematic views of a cathode structure of the electron gun; FIGS. 6A and 6B are enlarged views showing an essential portion of the cathode structure; and FIG. 7 is a front view of a heater used for the cathode structure.

In this embodiment, parts corresponding to those of the above-described prior art electron gun shown in FIGS. 1 to 4 are designated by the same reference numerals (characters), and explanation and graphic representation thereof are partially omitted.

Referring to FIGS. 5A and 5B, a cathode structure A is obtained by loosely inserting an inner sleeve 10 at the leading end of which an impregnated type cathode K is provided in an outer sleeve 20, fixing the inner sleeve 10 to the outer sleeve 20 with tabs 29, and assembling the outer sleeve 20 in a ceramic disk 22 via a holder 21.

As shown in FIGS. 6A and 6B, the inner sleeve 10 is a cylindrical member having an outside diameter "d" ranging from about 1.0 mm to about 1.4 mm and a length "1" (exclusive of a portion mounting the cathode K) ranging from about 3 mm to about 6 mm (preferably, ranging from about 4 mm to 5 mm). A heater 11 is built in the inner sleeve 10 in proximity to the impregnated type cathode K. As will be described later, the inner sleeve 10 is loosely inserted in a small-diameter portion of the outer sleeve 20.

Referring to FIG. 7, the heater 11 is specified such that a secondary spiral length H2 (the length of a spirally wound portion) is in a range of about 75% or less of the length "1" of the inner sleeve 10 (concretely, in a range of about 3 mm or less); a primary spiral length H1 (the sum of the length of the spirally wound portion and the length of a straight portion) is substantially equal to or less than the length "1" (that is, about 3 mm to about 6 mm, preferably, about 4 mm to 5 mm) of the inner sleeve 10; and the number of primary turns is about 165±3. The heater 11 generates heat by a voltage of about 5.0 V applied thereto, to heat the impregnated type cathode K.

The outer sleeve 20 is a cylindrical member having on the leading end side a small-diameter portion 20*a* having an outside diameter D1 ranging from about 2.2 mm to about 2.6 mm and having on the base end side a large-diameter portion 20*b* having an outside diameter D2 ranging from about 2.6 mm to 2.8 mm. The length of the small-diameter portion 20*a* is substantially equal to or more than the length "1" of the inner sleeve 10.

The inner sleeve 10 is loosely, coaxially inserted in the small-diameter portion 20*a* of the outer sleeve 20 with an annular gap kept therebetween, and is fixed thereto at positions spaced at equal intervals in the circumferential direction by means of a plurality of tabs (strap-like connecting members) 29. Each tab 29 is a strap-like (or strip-like) member having a thickness of about 0.02 mm and a width of about 0.35 mm. Both ends of the tab 29 in the longitudinal direction are welded to the leading end of the small-diameter portion 20*a* of the outer sleeve 20 and to the base end of the inner sleeve 10.

The holder 21 is fixed around the outer periphery of the base end of the large-diameter portion 20*b* of the outer sleeve 20 by resistance welding, brazing or the like, and the outer sleeve 20, and the ceramic disk 22 is assembled to the outer sleeve 20 via the holder 21. As described above, the first grid electrode G1 is directly mounted on the ceramic disk 22, and the second grid electrode G2 is mounted on the ceramic disk 22 via the spacer 23.

In this embodiment, the diameter of the inner sleeve 10 at the leading end of which the impregnated type cathode K is provided is reduced; the diameter of a portion of the outer sleeve 20 is reduced to form the small-diameter portion 20*a*; and the inner sleeve 10 is loosely inserted in the small-diameter portion 20*a* and is fixed thereto by means of the tabs 29.

To be more specific, the inner sleeve 10 is formed such that the outside diameter "d" thereof becomes about 1.0 to 1.2 mm and the small-diameter portion 20*a* of the outer sleeve 20 is formed such that the outside diameter D1 thereof becomes about 2.2 to 2.6 mm, and the inner sleeve 10 is inserted in the small-diameter portion 20*a* with a gap kept therebetween.

Accordingly, it is possible to reduce the caloric amount propagating by thermal radiation from the inner sleeve 10, and since a suitable gap is kept between the inner sleeve 10 and the small-diameter portion 20*a* of the outer sleeve 20, it is possible to reduce a calorie propagating by thermal transmission.

As a result, it is possible to prevent the grid electrodes G1 and G2 from being heated at high temperatures, to reduce the power consumption of the heater 11, and to rigidly fix the inner sleeve 10 to the outer sleeve 20 without enlarging the tabs 29.

In particular, since the heater 11 housed in the inner sleeve 10 is specified such that the secondary spiral length H2 is as short as about 3 mm or less; the primary spiral length H1 is as short as the length "1" of the inner sleeve 10 or less; the number of the primary turns is as small as about 165; and the applied voltage is as low as about 5.0 V, the thermal efficiency of the heater 11 can be improved and also the power consumption of the heater 11 can be reduced.

Since the ceramic disk 22 is assembled to the large-diameter portion 20*b*, having the outside diameter D2 ranging from about 2.6 mm to about 3.0 mm, of the outer sleeve 20 via the holder 21, the assembling work of the outer sleeve 20 can be simplified and the holder 21 can be forcibly fixed to the large-diameter portion 20*b*. That is to say, if the outside diameter of the outer sleeve 20 is made small, it becomes difficult to fix the holder 21 to the large-diameter portion 20*b* by resistance welding, brazing or the like; however, in this embodiment, the outside diameter D2 of the large-diameter portion 20*b* is not largely affected by the diameter "d" of the inner sleeve 10 because the inner sleeve 10 is not positioned in the large-diameter portion 20*b* of the outer sleeve 20, so that the degree of freedom in setting of the outside diameter D2 of the large-diameter portion 20*b* is large, and accordingly the outside diameter D2 can be made somewhat larger, to thereby facilitate the assembling work of the outer sleeve 10.

In the above embodiment, the applied voltage of the heater 11 is set at 4.5 V; however, it may be set at a value lower than 4.5 V.

Further, in the above embodiment, the size of the tab 29 is specified such that the thickness is 0.025 mm and the width is 0.30 mm; however, the size of the tab 29 may be set at a smaller value for reducing the caloric amount propagating by thermal conductance.

While the embodiment of the present invention has been described using the specific terms, such description is for illustrative purposes only, and it is to be understood that changes and variations may be made without departing the spirit or scope of the following claims.

What is claimed is:

1. An electron gun comprising:

a heater built-in inner sleeve having provided at a leading end thereof an impregnated type cathode, wherein an outside diameter of said heater built-in inner sleeve is in a range of substantially 1.0 mm to 1.2 mm;

an outer sleeve in which said heater built-in inner sleeve is inserted; and a plurality of strap-like supporting members attached at first ends thereof at a respective plurality of positions spaced at regular intervals in a peripheral direction to a leading end of said outer sleeve and attached at second ends thereof to a base end of said inner sleeve opposite said leading end, such that said heater built-in inner sleeve is disposed coaxially with said outer sleeve, said impregnated type cathode is positioned at the leading end of said outer sleeve, and said heater built-in inner sleeve is separated from said outer sleeve by an annular space therebetween, wherein said outer sleeve has on the leading end a small-diameter portion having a diameter smaller than a diameter of the remaining portion of said outer sleeve on a base end, said heater built-in inner sleeve is positioned in said small-diameter portion, and the leading end of said small-diameter portion of said outer sleeve is connected to the base end of said inner sleeve by said plurality of strap-like connecting members.

2. The electron gun according to claim 1, further comprising: a holder fixed around an outer peripheral surface of the base end of said outer sleeve;

a ceramic disk assembled to said outer sleeve via said holder and a first grid electrode G1 and a second grid electrode G2 assembled to said ceramic disk, thereby forming a cathode structure.

3. The electron gun according to claim 1, wherein an outside diameter of said small-diameter portion of said outer sleeve is in a range of substantially 2.2 mm to 2.6 mm, and an outside diameter of a remaining portion of said outer sleeve on the base end is in a range of substantially 2.6 mm to 2.8 mm.

4. The electron gun according to claim 1, wherein a primary spiral length of a heater in said heater built-in inner sleeve is substantially equal to a length of said heater built-in inner sleeve, and a secondary spiral length of said heater is about 75% or less of the length of said heater built-in inner sleeve.

5. The electron gun according to claim 4, wherein each of the length of said heater built-in inner sleeve and the primary spiral length of said heater is in a range of substantially 4 mm to 5 mm, and the secondary spiral length of said heater is substantially 3 mm or less.

* * * * *